United States Patent [19]

Orr et al.

[11] 3,933,020

[45] Jan. 20, 1976

[54] METHOD FOR STRETCH WRAPPING OF PANELS

[75] Inventors: Lavern G. Orr, Tustin; Etric Lee Stone, Costa Mesa, both of Calif.

[73] Assignee: TRE Corporation, Beverly Hills, Calif.

[22] Filed: July 18, 1974

[21] Appl. No.: 489,618

[52] U.S. Cl. ..... 72/297; 72/342

[51] Int. Cl.[2] ..... B21D 11/02

[58] Field of Search ..... 72/302, 305, 308, 298, 72/303, 297, 342, 311, 364, 378, 379; 29/157.3 V, 455 LM

[56] References Cited

UNITED STATES PATENTS

| | | | |
|---|---|---|---|
| 2,279,964 | 4/1942 | Berliner | 72/305 |
| 2,325,481 | 7/1943 | Crawford | 72/342 |
| 2,442,268 | 5/1948 | Fields et al. | 72/297 |
| 2,443,336 | 6/1948 | Waldie | 72/342 |
| 2,632,493 | 3/1953 | Gray et al. | 72/297 |
| 2,824,594 | 2/1958 | Gray | 72/297 |
| 3,021,887 | 2/1962 | Maynard | 72/297 |
| 3,073,373 | 1/1963 | Wheeler et al. | 72/297 |
| 3,077,031 | 2/1963 | Fromson | 29/157.3 V |
| 3,785,788 | 1/1974 | Haggberg et al. | 29/455 LM |
| 3,788,117 | 1/1974 | Chester et al. | 72/296 |

*Primary Examiner*—Milton S. Mehr

*Attorney, Agent, or Firm*—Blakely, Sokoloff, Taylor & Zafman

[57] ABSTRACT

A method of stretch wrapping metallic panels, particularly honeycomb structure sandwich panels, in which the panel is heated by passing an electrical current through it during the forming step. A pair of electrode tabs are joined to opposing edges of the panel and are gripped in gripper jaws which are slidable between tapered blocks so that as more tension is created in the panel, the jaws tighten. The electrical connections are made to the tapered blocks and current flows to the panel across the sliding joint and through the jaws.

3 Claims, 10 Drawing Figures

Fig. 1
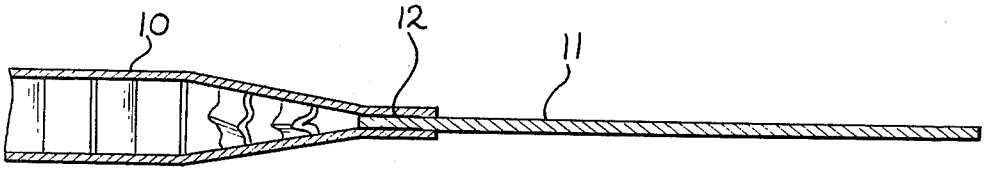
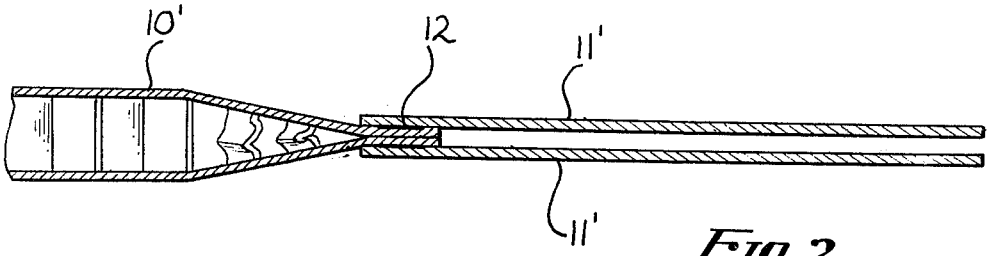
Fig. 2
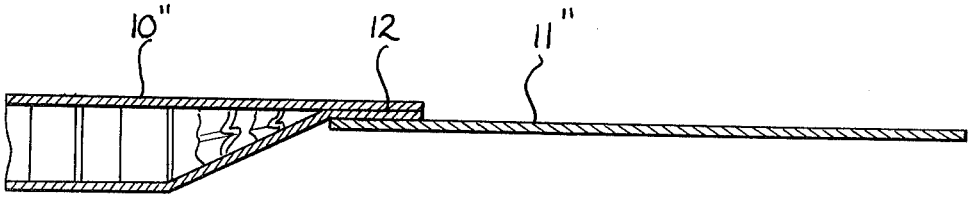
Fig. 3

METHOD FOR STRETCH WRAPPING OF PANELS

BACKGROUND OF THE INVENTION

1. Field of the Invention

This invention relates to the field of stretch wrapping of panels and more particularly to methods for electrically heating panels to be stretch wrapped.

2. Prior Art

Prior art methods of stretch wrapping of panels, such as honeycomb panels, involve the welding of tabs to the panel to provide a member through which tension may be applied during the wrapping process, and also to provide an electrical contact so that heating current can be passed through the panel. The tab and panel must be long enough to allow relatively large sized electrical bus bars to be connected to the panel, since it is common to require 10,000 to 15,000 amperes of current for heating the panel to the proper forming temperature.

The electrical connections have previously been made by clamping bus bars directly to the panel to be stretch wrapped. Difficulties have been encountered with the prior art methods of making the electrical connection, which the present invention is intended to overcome. Due to the large conductors and currents involved, it is is difficult to get a sufficient clamping area to prevent localized overheating of the panel. Achieving a sufficient number of good connections between the bus bars and the panel to provide even heating of the entire panel is also a problem which has had no easy solution in the prior art.

SUMMARY OF THE INVENTION

In accordance with the present invention, a panel to be stretch wrapped has electrode tabs attached to two substantially parallel edges of the panel as by welding, preferably resistance seam welding. When a honeycomb structure panel is to be formed (i.e. a sandwich comprised of a honeycomb core resistance welded to upper and lower face sheets), the core of the panel is sealed against the entry of air and an inert gas is circulated therethrough to prevent oxidation during the wrapping operation. The electrode tabs are then grasped by a plurality of insulated gripper jaws which serve not only to pull on the panel, creating tension, but also to act as the electrical connections to the tabs, thereby eliminating the need for separate electrical connections.

The gripper jaws are constructed so that as tension in the panel is increased, the clamping action increases, improving the electrical connection to the electrode tabs.

BRIEF DESCRIPTION OF THE DRAWINGS

FIG. 1 is a cross-sectional view of an edge of a panel to be formed showing one method of attaching the electrode tab;

FIG. 2 is a cross-sectional view of an edge of a panel to be formed showing an alternate method of attaching the electrode tab;

FIG. 3 is a cross-sectional view of an edge of a panel to be formed showing still another method of attaching the electrode tab;

DETAILED DESCRIPTION OF THE INVENTION

Figure 4:
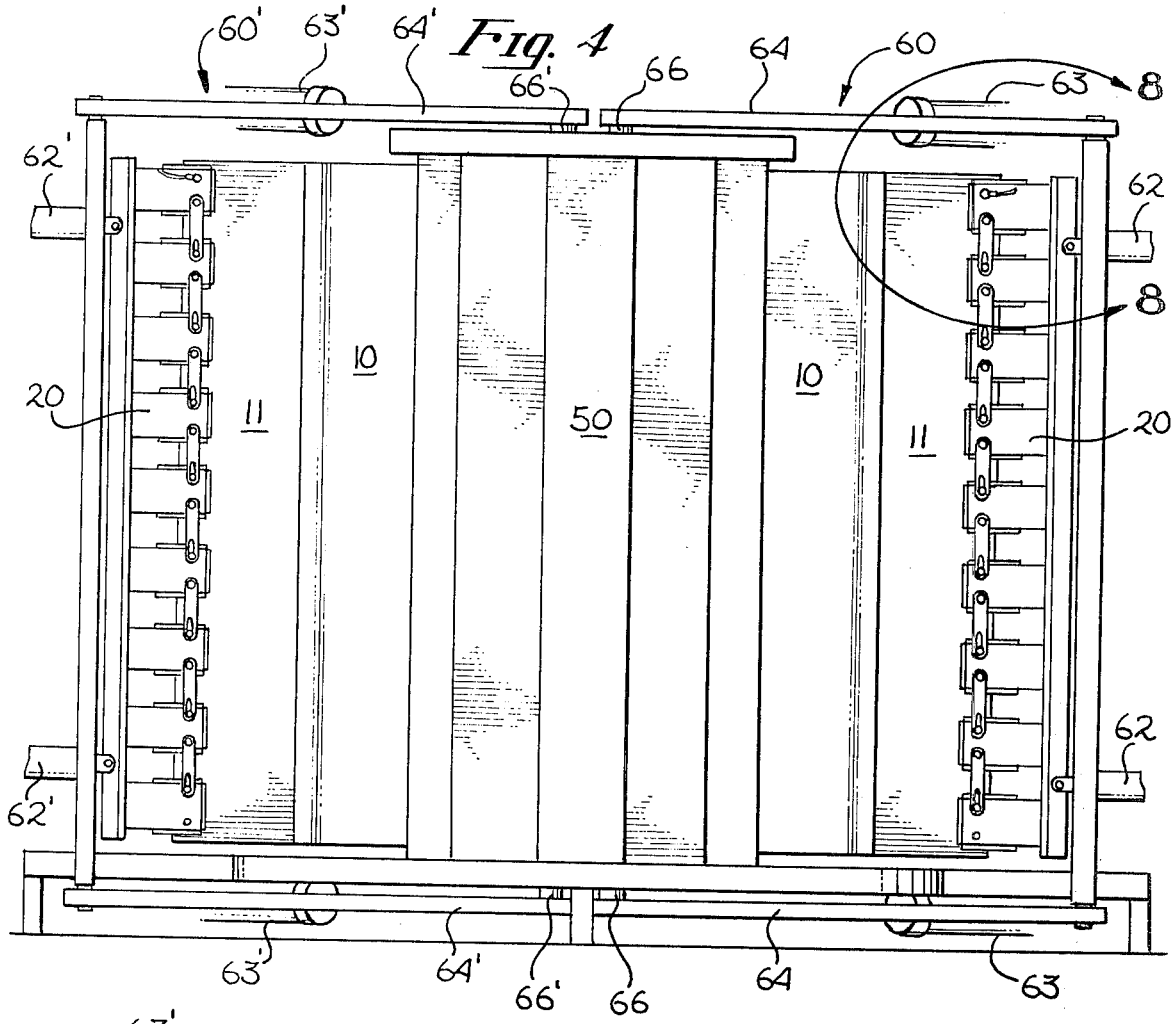
FIG. 4 is a frontal view of a portion of a preferred stretch wrapping apparatus or machine showing a panel ready to be formed in accordance with the invented method and being held by the gripper assemblies.

This invention may be most easily understood by referring first to FIGS. 1, 2 and 3, wherein one edge of a honeycomb material panel 10, 10′ or 10″, which is to be stretch wrapped, is shown, having electrode tabs 11, 11′ or 11″ attached. The figures show three alternative methods of attachment of the electrode tab, but as will be appreciated by those skilled in the art, other methods may be employed within the spirit of the invention. An electrode tab, such as is shown in FIGS. 1, 2 and 3, is attached to each of two substantially parallel edges of the panel 10 as may be seen in the plan view of a panel ready to be formed in FIG. 1.

In FIG. 1 the edge of the panel which is to receive the tab is crushed symmetrically on the tab 11, and resistance seam welded thereto. The area of the seam weld 12 should be large enough to withstand the stretch forces applied during forming. These forces can be quite large; for example, in forming a typical titanium honeycomb panel with 0.030 inches face sheets, a stretching force commonly used in 3,200 pounds per inch width of panel. The electrode tab 11 itself must also be made heavy enough to withstand such force. The electrode tab should be made of a relatively heavy sheet for another reason and this is so that excessive heating does not occur in the tab due to current flowing in it. It is desirable, for the same reason, that the electrode tab should be made of the highest conductivity material available, consistent with other requirements such as cost, weldability, strength, etc. The electrode tab need only be long enough to be grasped in the clamp jaws as will be described below. Since the current is introduced through the jaws, no extra length of tab is required for the electrical connection.

While the present invention is described as applied to stretch wrapping of honeycomb panel, it will be apparent to those skilled in the art that the method and preferred apparatus described herein would also be suitable for stretch wrapping of other metallic sheet materials and other panel constructions.

FIG. 2 shows an alternate electrode tab arrangement. Here the edge of the panel 10′ is crushed and two tabs 11′, one on each side of the crushed edge, are resistance seam welded to the panel.

In FIG. 3, still another alternate arrangement is shown. One side of the panel 10″ is shown crushed unsymmetrically against the other side and electrode tab 11″ is resistance seam welded thereto.

The invented method will be described with respect to the honeycomb panel as shown in FIG. 1 but it will be understood that the same steps are applicable to the alternate tab attachment methods of FIGS. 2 and 3 and many of the steps are applicable to the stretch forming of plain sheets panels.

The electrode tabs 11 are gripped by a plurality of gripper assemblies 20 preparatory to the heating and stretch wrap operation. FIG. 4 shows a panel 10 with its electrode tabs 11 being gripped by eighteen gripper assemblies 20 and 20', nine on each tab just prior to the heating and wrapping of the panel around the form block 50.

Figure 5:
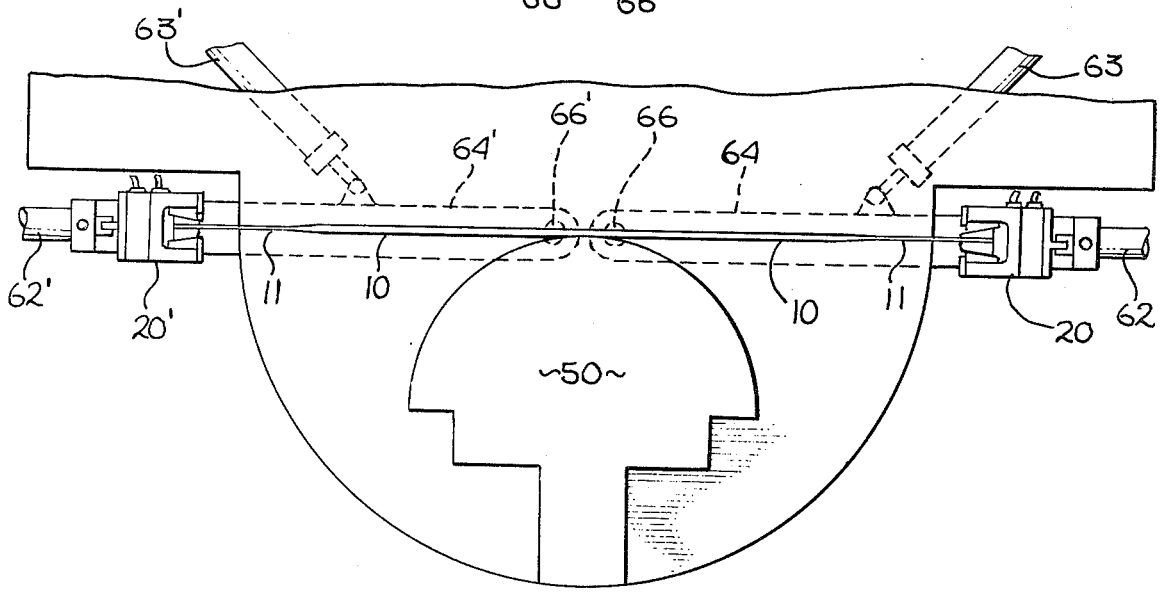
FIG. 5 is a top view of the portion of the machine shown in FIG. 4 with a panel ready to be formed.
Figure 6:
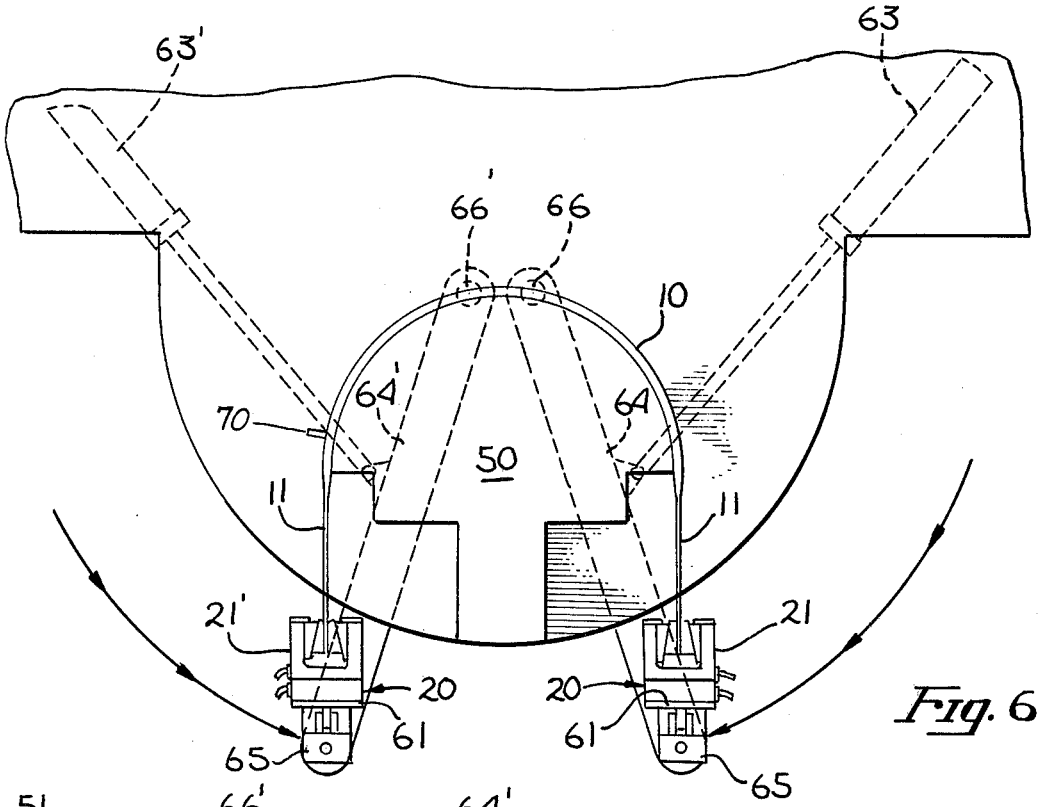
FIG. 6 is a top view of the portion of the machine as in FIG. 5, showing the panel fully formed.

The form block 50 is fastened securely at top and bottom to the main frame 51 of the forming machine and is made of a strong heat resistant refractory material. One suitable material is called "Glassrock" and is made by Glassrock Products, Inc. of Santa Monica, Calif. Since substantial forces are involved in the stretch wrapping process, the form block 50 must be made quite sturdily. The surface contours of form block 50 is made so as to conform to the desired finished panel contour. FIGS. 5 and 6 show the manner in which the panel is formed around the form block to provide the finished panel contour.

Figure 9:
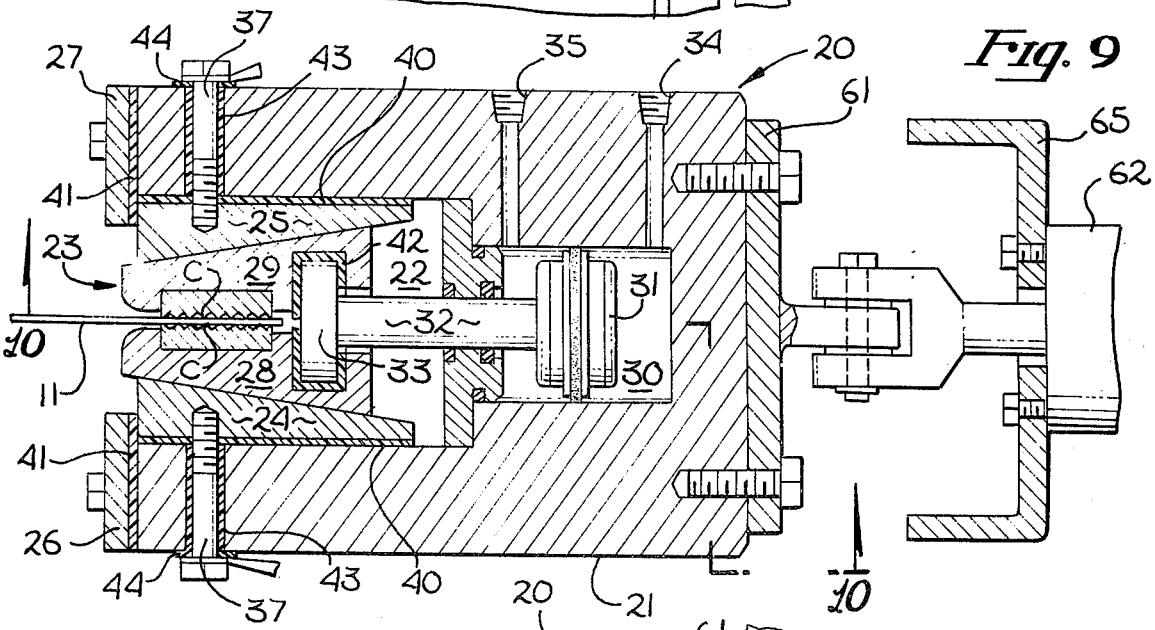
FIG. 9 is a cross-sectional view of one of the gripper assemblies, taken at 9—9 of FIG. 8.
Figure 10:
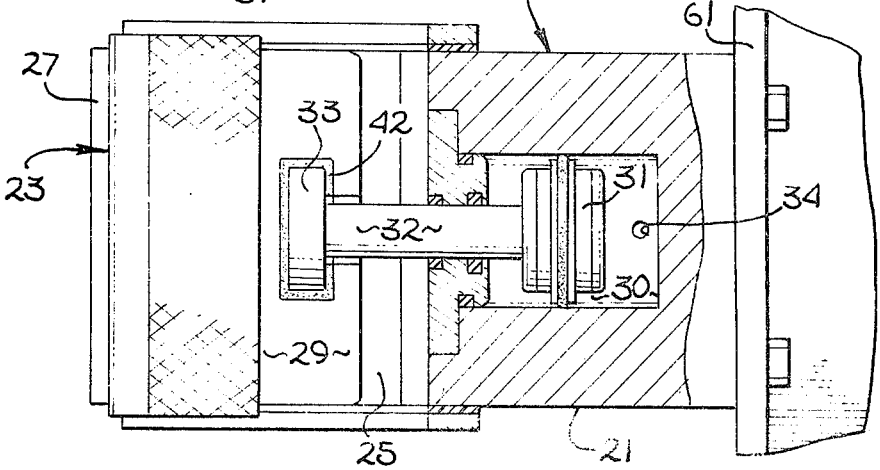
FIG. 10 is a cross-sectional view of one of the gripper assemblies taken at 10—10 of FIG. 9.

Each gripper assembly 20 or 20', as shown in cross section in FIGS. 9 and 10, comprises a body 21 having a substantially rectangular cavity 22 adjacent a front opening 23. A pair of jaw guides 24 and 25 are retained in the cavity by lips 26 and 27 at the front of the cavity, and jaws 28 and 29 slide thereon.

A hydraulic actuator comprised of cylinder 30, piston 31, and push rod 32 is used to cause jaws 28 and 29 to grip the electrode tab initially and to release the tab after forming. Head 33 on push rod 32 fits into recesses in the jaws so that both push and pull actions can be effected by the actuator. When pressure is applied behind piston 31, through port 34, the jaws are forced forward and the inclined surfaces of jaw guides 24 and 25 cause the jaws 28 and 29 to close. Conversely, pressure in port 35 will cause the jaws to open.

The clamping surfaces C of jaws 28 and 29 are knurled or otherwise roughened in order to keep the tab from sliding when tension is applied, and to improve the electrical connection to the tab. The inclined surfaces between the jaws 28 and 29 and the jaw guides 24 and 25 causes a wedging action as tension is applied to the tab increasing the grip of the jaws on the tab 11.

Electrical heating energy is coupled to the tabs, and hence to the panel 10 to be formed, through the jaws 28 and 29. Both the jaws and the jaw guides 24 and 25 are electrically "hot " and must be insulated from the body 21 which is not insulated from ground. The insulation is accomplished by sheets 40 and 41 of thin insulating material, such as glass filled melamine, and piston insulators 42, which also may be fabricated of glass filled melamine. Insulating sleeves 43 and washer 44 insulate studs 37 and links 36 which serve to introduce the electrical energy to the gripper assembly. All of the jaws gripping one of the electrode tabs are connected in parallel and the heating current flows from one tab to the other, heating the panel being formed, so that the material will yield and conform to the contours of the form block 50.

Pivoted substantially even with the top surface of form block 50 (at 66), and symmetrically on each side of the centerline of the block, are yokes 60 and 60'. The wrapping machine is symmetrical with respect to the centerline of the block so that, while only the components assembled to yoke 60 will be described, it is to be understood that similar components related to yoke 60' exist on the opposite side of the machine. The yoke 60 comprises a pair of arms 64, one adjacent each end of form block 50, and a cross member 65 pivoted at the end of arms 64.

Figure 7:
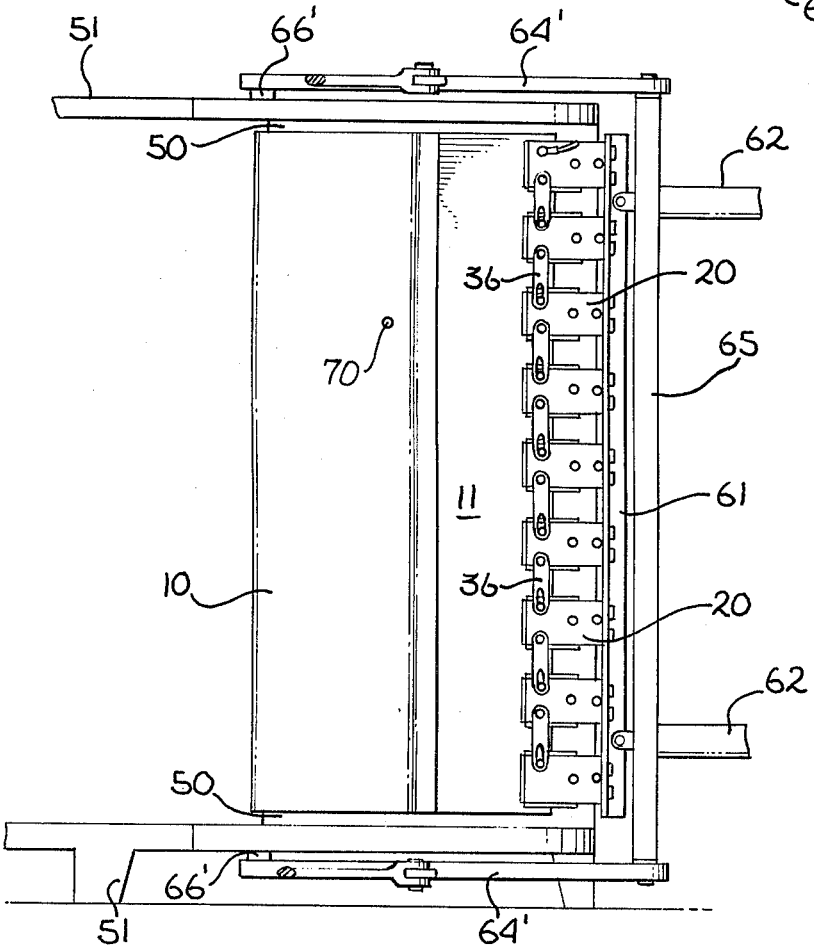
FIG. 7 is a partial rear view of the apparatus of FIG. 4, showing the means for creating tension in the panel.
Figure 8:
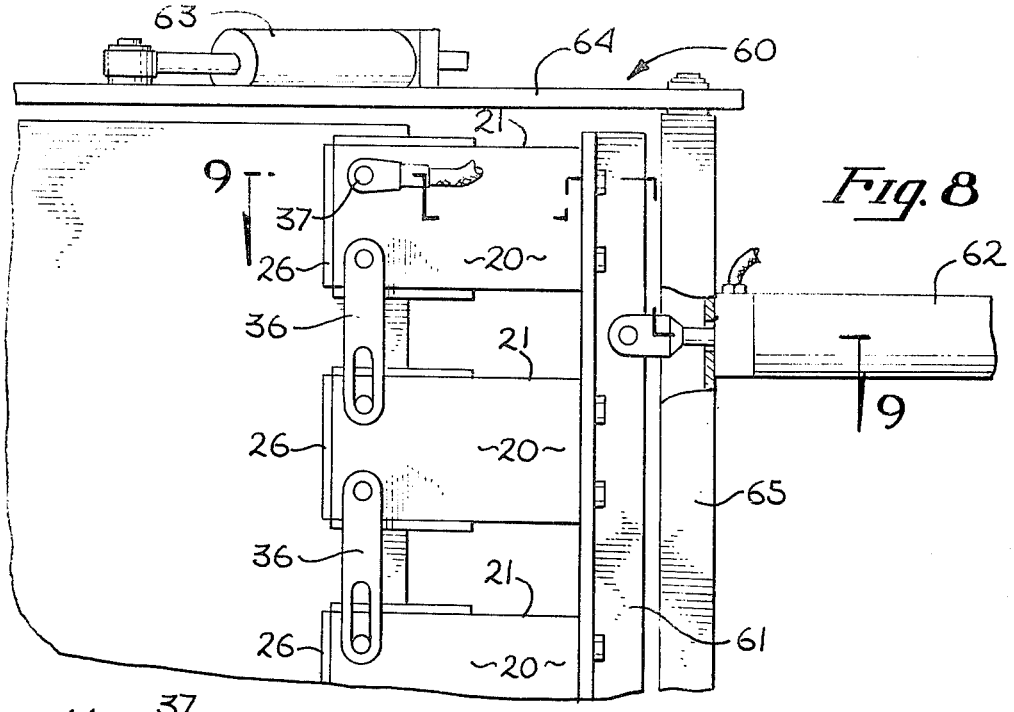
FIG. 8 is a more detailed partial front view of the apparatus showing the area of line 8—8 of FIG. 4.

The cross member 65 carries a pair of hydraulic cylinders 62 which drive beam 61. A plurality of gripper assemblies 20 are attached to beam 61 as shown in FIG. 8 so that as hydraulic pressure is applied to cylinders 62, and 62' on the opposing yoke 60', tension will be applied to panel 10, as best shown in FIG. 7 with respect to cylinders 62.

Another pair of hydraulic cylinders 63, attached to the frame of the wrapping machine, are coupled to the arms 64 so that as these cylinders are actuated, the yoke 60 will rotate about its pivot 66 and the panel 10 will be formed around form block 50. FIG. 6 shows the position of the various parts when cylinders 63 and 63' are in their fully extended position with panel 10 having assumed the shape of form block 50. Form block 50 is shown as a section of a circular cylinder for purposes of example only, and it will be obvious to those skilled in the art that other forms could as easily be used so that the panel 10 could be formed into relatively intricate or complex shapes using the invented process.

As previously been alluded to, the panel 10 is electrically heated prior to the forming step by passing a large electrical current through the panel from one set of gripper assemblies 20 to the other. The temperature which should be attained for best results depends upon the particular materials from which the panel is fabricated. A titanium honeycomb structure, for example, is best stretch wrapped when the temperature of the panel is in the range of 1,100° F to 1,150° F.

Many materials such as, for example, titanium, oxidize at the desirable forming temperature and in such cases, if the panel is a honeycomb structure, it would be very difficult to remove the oxidation from the interior portion. When such material is being formed, therefore, the interior is filled with a relatively inert gas such as helium or argon. To accomplish this, the entire periphery of the panel is sealed as by welding and a tube 70 which communicates with the interior of the panel is installed. The interior of the panel is then evacuated through the tube 70 and back filled with the inert gas and maintained at a positive pressure until forming is completed.

What has been described is a novel and useful method of stretch wrapping metal panels, including honeycomb structures, economically and conveniently. Summarizing the steps of the invented method, a pair of electrode tabs are first welded to two substantially parallel edges of the panel to be formed in order to provide a uniform clamping area and means for introducing heating current to the panel. If the panel is a honeycomb structure, the edges are then sealed and the interior is filled with an inert gas. The panel is then clamped in the wrapping apparatus with a plurality of gripper assemblies which contain jaws electrically insulated from the frame of the apparatus and connected to a source of substantial electrical power. The jaws are preliminarily tightened by means of hydraulic actuators within the gripper assemblies and stretching force applied also by hydraulic means. The gripper jaws are arranged to grip the panel, tighten as tension is applied and thus insure good electrical contact. The panels are then brought up to forming temperature and the panel wrapped around the form block so as to form the panel to the contours of the block. Various modifications and adaptations of the steps disclosed will occur to those skilled in the art and such are intended to be within the spirit of the invention as measured by the appended claims.

We claim:

1. A method of stretch forming a honeycomb structure sandwich panel which comprises:

a. joining a pair of electrode tabs to opposing edges of said panel;

b. sealing the periphery of said panel;

c. gripping each of said electrode tabs between two groups of pairs of jaws, each of said pair of jaws being slideable between a pair of tapered blocks, whereby the clamping force between each pair of jaws will increase as tension is applied to said panel;

d. applying force to separate said groups of pairs of jaws, whereby tension will be created in said panel;

e. coupling a source of electrical current to said tapered blocks, all of said tapered blocks gripping one of said electrode tabs being coupled in parallel;

f. circulating an inert gas through the interior of said panel while said panel heated by said electrical current; and g. wrapping said panel about a form block wherey said panel will assume the contours of said form block.

2. The method of claim 1, wherein said electrode tabs are joined to said panel by welding.

3. A method of forming a honeycomb sandwich panel in a stretch forming apparatus which comprises the steps of:

a. attaching a pair of metallic sheets to two spaced edges of said panel;

b. sealing the periphery of said panel and filling the interior of said panel with an inert gas;

c. gripping substantially parallel edges of said metallic sheets between two groups of pairs of jaws, each of said groups of jaws being electrically insulated from the frame of said apparatus of said jaws being arranged to grip said panel with increasing force as tension is applied to said panel;

d. applying force to separate said groups of pairs of jaws whereby tension will be created in said panel;

e. applying an electrical potential to said metallic sheets and panel between said groups of pairs of jaws, each pair of jaws within each group being coupled;

f. wrapping said panel about a form block, whereby said panel will assume the contours of said form block.

* * * * *